US010074923B1

(12) United States Patent
Crofoot et al.

(10) Patent No.: US 10,074,923 B1
(45) Date of Patent: Sep. 11, 2018

(54) AXIAL COMPLIANT COMPRESSION ELECTRICAL CONNECTOR

(71) Applicant: Ohio Associated Enterprises, LLC, Painesville, OH (US)

(72) Inventors: Larry M. Crofoot, Perry, OH (US); John T. Venaleck, Painesville, OH (US)

(73) Assignee: Ohio Associated Enterprises, LLC, Painesville, OH (US)

( * ) Notice: Subject to any disclaimer, the term of this patent is extended or adjusted under 35 U.S.C. 154(b) by 0 days.

(21) Appl. No.: 15/048,148

(22) Filed: Feb. 19, 2016

Related U.S. Application Data

(60) Provisional application No. 62/118,120, filed on Feb. 19, 2015, provisional application No. 62/191,557, filed on Jul. 13, 2015.

(51) Int. Cl.
*H01R 13/24* (2006.01)

(52) U.S. Cl.
CPC ..... *H01R 13/2407* (2013.01)

(58) Field of Classification Search
CPC ..... H01R 13/2407
USPC ..... 439/700, 578
See application file for complete search history.

(56) References Cited

U.S. PATENT DOCUMENTS 4,546,542 A * 10/1985 Proud ..... H01R 43/16 29/564.6
4,636,026 A 1/1987 Cooney
5,038,467 A * 8/1991 Murphy ..... H01R 12/52 29/741
5,221,209 A 6/1993 D'Amico
5,362,241 A * 11/1994 Matsuoka ..... H01R 13/2471 439/591
6,241,560 B1 * 6/2001 Furusawa ..... H01R 13/2471 439/700
6,287,144 B1 * 9/2001 Baffert ..... H01R 4/28 439/578
6,299,459 B1 * 10/2001 Botka ..... G01R 1/0466 439/66
6,861,862 B1 * 3/2005 Tate ..... G01R 1/0466 324/756.02
7,201,584 B1 * 4/2007 Ju ..... H01R 13/2407 439/66
7,256,593 B2 * 8/2007 Treibergs ..... G01R 1/0466 324/754.05
7,479,794 B2 1/2009 Chartarifsky et al.
7,794,237 B1 * 9/2010 Terhune, IV ..... H01R 13/2407 439/66
8,033,872 B2 * 10/2011 Yang ..... H01R 12/714 439/66

(Continued)

OTHER PUBLICATIONS

Claims from co-pending U.S. Appl. No. 15/241,755, filed Aug. 19, 2016.

*Primary Examiner* — Michael A Lyons
*Assistant Examiner* — Milagros Jeancharles
(74) *Attorney, Agent, or Firm* — Renner, Otto, Boisselle & Sklar, LLP

(57) ABSTRACT

An electrical connector is revealed that has unique useful characteristics. A sheet metal fork supplies the stored energy that imparts a force to a second member—a plunger that makes contact with the mating circuit. The plunger can be configured to increase or decrease the force or deflection and can be designed with various connection ends with different contact characteristics.

14 Claims, 13 Drawing Sheets

(56) References Cited

U.S. PATENT DOCUMENTS

| | | | | |
|---|---|---|---|---|
| 8,047,875 | B2 * | 11/2011 | Yamakami | H01R 13/6315 439/108 |
| 8,210,855 | B1 * | 7/2012 | Lin | H01R 12/716 439/66 |
| 8,262,419 | B2 * | 9/2012 | Chen | H01R 13/2421 439/700 |
| 8,373,430 | B1 * | 2/2013 | Sochor | H01R 13/2421 29/874 |
| 8,441,275 | B1 * | 5/2013 | Alladio | G01R 1/0466 324/756.01 |
| 8,460,010 | B2 * | 6/2013 | Kimura | G01R 1/06722 439/66 |
| 8,573,983 | B2 * | 11/2013 | Zieder | H01R 11/09 439/8 |
| 8,715,015 | B2 * | 5/2014 | Hwang | G01R 1/06722 439/700 |
| 9,190,749 | B2 * | 11/2015 | Chen | H01R 12/714 |
| 9,214,746 | B2 * | 12/2015 | Kobayashi | H01R 13/2435 |
| 2004/0038586 | A1 * | 2/2004 | Hall | H01R 13/6315 439/578 |
| 2007/0077785 | A1 * | 4/2007 | Ju | H01R 13/2435 439/66 |
| 2012/0238136 | A1 * | 9/2012 | Hwang | G01R 1/06722 439/607.01 |

* cited by examiner

AXIAL COMPLIANT COMPRESSION ELECTRICAL CONNECTOR

This application claims priority under 35 USC 119 to U.S. Provisional Application 62/118,120, filed Feb. 19, 2015, and to U.S. Provisional Application 62/191,557, filed Jul. 13, 2015. Both of these provisional applications are incorporated by reference in their entireties.

BACKGROUND OF THE INVENTION

Field of the Invention

This invention is in the field of electrical connectors, and contacts for electrical connectors.

Description of the Related Art

An electrical connector device common in the Industry for decades is known as the pogo pin. These devices are typically cylindrical with a pin-like plunger and a helical coil spring, the combination of which forms a compression connector. The pin is urged by the spring into a mating surface which is an electrical connection point. These devices are most commonly used in testing equipment where unusual surfaces must be accommodated and usually require good reliability over many cycles. These devices are not normally used where very high bandwidth is required nor are they typically designed into input-output (IO) devices such as cable interface and permanent circuit board to circuit board connectors. Also typical of these pogo pin devices is reasonably high cost of manufacture and an electrical current path that is not clearly defined.

SUMMARY OF THE INVENTION

The present invention is a spring-loaded connector that attacks many of the short comings of the previously-mentioned pogo devices. In addition this connector lends itself to a variety of applications, which the former is not uniquely qualified for.

According to an aspect of the invention, a compliant electrical contact includes: at least two conductive elements (or members); wherein one of the conductive elements has a portion within and movable relative to a portion of another of the conductive elements; and wherein the relative movement of the conductive elements provides a force of the compliant electrical contact against a conductive pad or a noncompliant contact, making an electrical connection with the conductive pad or the noncompliant contact.

In an embodiment according to any one or more paragraphs of this summary, the elements include a plunger, and a receiver for receiving the plunger.

In an embodiment according to any one or more paragraphs of this summary, the receiver is a fork with a pair of tines, and the plunger engages the fork between the tines.

In an embodiment according to any one or more paragraphs of this summary, the plunger resiliently bends the tines by insertion between them.

In an embodiment according to any one or more paragraphs of this summary, the plunger can also include a pair of arms or beams that resiliently deform as the plunger is inserted into the receiver.

In an embodiment according to any one or more paragraphs of this summary, the plunger will have a hard stop feature or features.

In an embodiment according to any one or more paragraphs of this summary, the receiver elements are captured in a header.

In an embodiment according to any one or more paragraphs of this summary, at least some of the elements are secured in the connector by retainers that pass into closed or open holes or elongate slots in the elements.

In an embodiment according to any one or more paragraphs of this summary, at least some of the elements are replaceable elements.

In an embodiment according to any one or more paragraphs of this summary, the receiver includes a pair or more of identical fork elements that form a laminate whose thickness is equal to a single fork thickness.

In an embodiment according to any one or more paragraphs of this summary, the laminated fork elements engage the same plunger.

In an embodiment according to any one or more paragraphs of this summary, the fork elements have substantially the same shape.

According to another aspect of the invention, an electrical connector includes: a header with one or more fork elements imbedded therein; and a companion plunger for each fork element; wherein, each pair of fork and plunger form a conductive electrical path; wherein the relative movement of the conductive elements provides a force of the compliant electrical contact against a conductive pad or a noncompliant contact, making an electrical connection with the conductive pad or the noncompliant contact.

According to another aspect of the invention, an electrical connector includes: a header; and compliant contacts within the header; wherein each of the compliant contacts includes at least two conductive elements (or members); wherein one of the conductive elements has a portion within and movable relative to a portion of another of the conductive elements; and wherein the relative movement of the conductive elements provides a force of the compliant electrical contact against a conductive pad or a noncompliant contact, making an electrical connection with the conductive pad or the noncompliant contact.

According to another aspect of the invention, the plunger in contact with both tines of the fork receiver forms a redundant or parallel electrical path.

According to another aspect of the invention, the total compliant deflection of the electrical path formed by the conductive elements is a constant times the number of forks in the electrical path.

According to yet another aspect of the invention, a compliant electrical contact includes: a pair of conductive elements that include: a plunger; and a receiver; wherein the plunger is movable relative to the receiver to put part of the plunger within part of the receiver, to resiliently deform the plunger and/or the receiver, to thereby provide a force of the compliant electrical contact to engage a conductive pad or a noncompliant contact external to the compliant electrical contact.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

An electrical connector is revealed that has unique useful characteristics. A sheet metal fork supplies the stored energy that imparts a force to a second member—a plunger that makes contact with the mating circuit. The plunger can be configured to increase or decrease the force or deflection and can be designed with various connection ends with different contact characteristics.

As an alternative to pogo pins, an electrical connector may have a series of compliant contacts that include plungers engaging compliant members. In one embodiment the compliant members are forks that receive portions of the plungers between tines of the forks, such that movement of the plungers in an axial direction resiliently moves the tines laterally outward, making contact between the plungers and the compliant members.

Figure 1B:
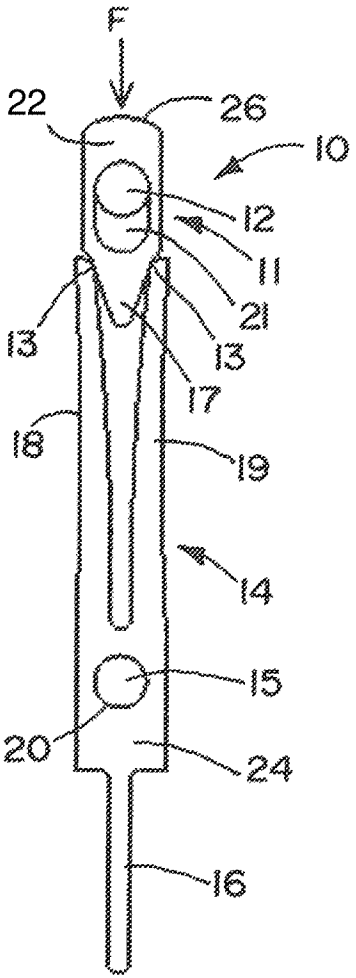
FIG. 1B is a side view of the contact of FIG. 1A in a deflected position.
Figure 1A:
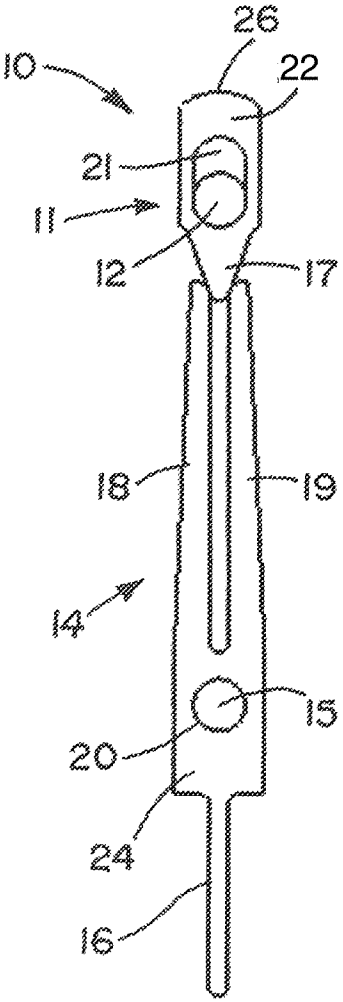
FIG. 1A is a side view of an electrical contact according to an embodiment of the invention, with the contact in an extended position.

FIGS. 1A and 1B show one embodiment of the broad concept of a compliant contact, according the invention. The contact 10 includes a plunger 11 and a fork 14. FIG. 1A shows the device in the extended position, and FIG. 1B shows the device in the deflected position. The plunger 11 has a tip 17 that fits between tines 18 and 19 of the fork 14. The deflected tines 18 and 19 cause an inward force on the ramps (sloped surfaces) of the tip 17, shown at locations 13, urging the plunger 11 upward against the connecting force F. The opposite end 26 of the plunger 11 is rounded or otherwise narrowed, for engagement with a contact pad on a circuit board or the like. The compliant contact thus has some range of movement, while still providing force against a contacting surface, and providing reversible balanced forces that allow the contact to resume its original shape when the force against it is released. Both of the contact members, the plunger 11 and the fork 14, have respective holes 20 and 21 in a plunger body 22 and in a fork body 24, for receiving parts of a connector body, such as molded plastic body retainers or hard stops 12 and 15, to keep the contacts 11 and 14 held within the plastic body. The fork 14 has a circular hole 20 with the fork not moving relative to the connector body during operation, and the plunger has an elongated hole 21, allowing some movement of the plunger relative to the header body.

The hole 20 may be a round hole, and/or a hole that has about the same shape as that of the retainer 15 that is in the hole 20. The retainer 15 may thus keep the fork 14 in place relative to the connector body of which the retainer 15 is a part. The hole 21 has an elongate shape that is larger than the retainer 12 in an axial direction, the direction of the connecting force F. This allows the plunger 11 to move relative to the connector body.

The tip (or connection end) 16 at the opposite end of the fork 14 from the tines 18 and 19 may be connected to a wire of a cable, or to another electrical conductor. The rounded or otherwise narrowed plunger end 26 may protrude from the connector body, for coupling to contact pads or contacts of another connector.

The connection end 16 of the fork 14 may be used to connect that end of the contact to another conductive member. For example the connection may be used to make connection to a cable or to a circuit board.

The plunger 11 and the fork 14 may be made of a suitable electrically-conductive material, such as copper or nickel-plated copper. The connector body that includes the body retainers or hard stops 12 and 15 may be made of a suitable plastic, such as a suitable thermoplastic.

Many alternative configurations are possible. For example, one alternative would be a ramped member, akin to the plunger 11, having a connection end and being fixed relative a connector body, while a forked member, akin to the fork 14, has a rounded or otherwise narrowed end for coupling to contact pads or other contacts, and is able to move in an axial direction relative to the connector body.

The contact 10 may be used in connectors of any of a wide variety of configurations. Some examples of such connectors are described below, but should not be considered limiting.

Figure 2:
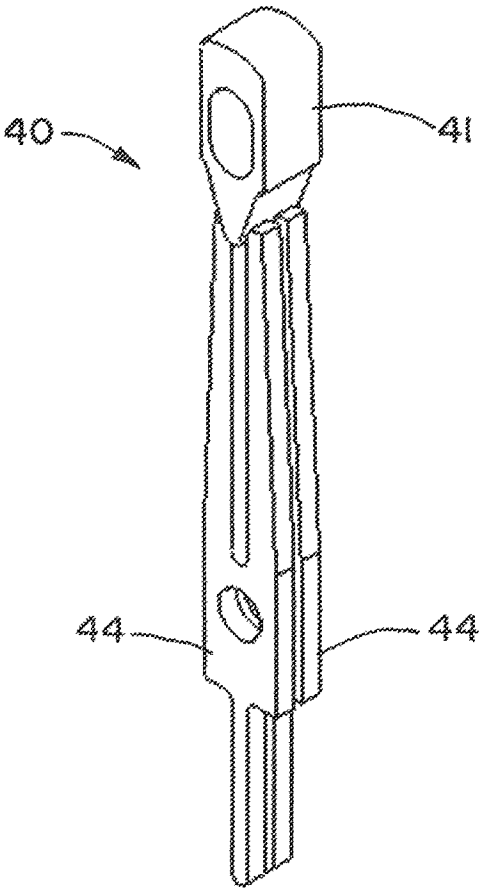
FIG. 2 is an oblique view of an electrical contact according to another embodiment of the invention.

FIG. 2 shows an alternative arrangement for a contact 40. The contact 40 includes two thin forks 44 and 45, each similar in configuration to the fork 14 (FIGS. 1A and 1B), that are in contact with a plunger 41, similar to the plunger 11 (FIGS. 1A and 1B). The forks 44 and 45 may have substantially identical shapes, and may overlap one another substantially completely, moving parallel to one another, and offset from one another in a direction perpendicular to the direction of movement. The two forks 44 and 45 together may have a thickness that is equivalent to the one-piece (thicker) fork 14 that they replace. Multiple forks provide multiple wear paths. Each wear path is subjected to a fraction of the contact forces imposed by the original one piece fork.

The multiple contact forces yield the same functional dynamics as the one piece fork with a fraction of the wear at the surface. For the same precious metal plating thickness, many more cycles would be allowed before the protective layer is compromised, or for a given number of cycles, less plating thickness would be required to achieve similar performance, which yields a cost savings.

In other respects the contact 40 may be similar to the contact 10 (FIGS. 1A and 1B). The contact 40 may engage a plastic connector body in a manner similar to that of the contact 10.

Figure 3A:
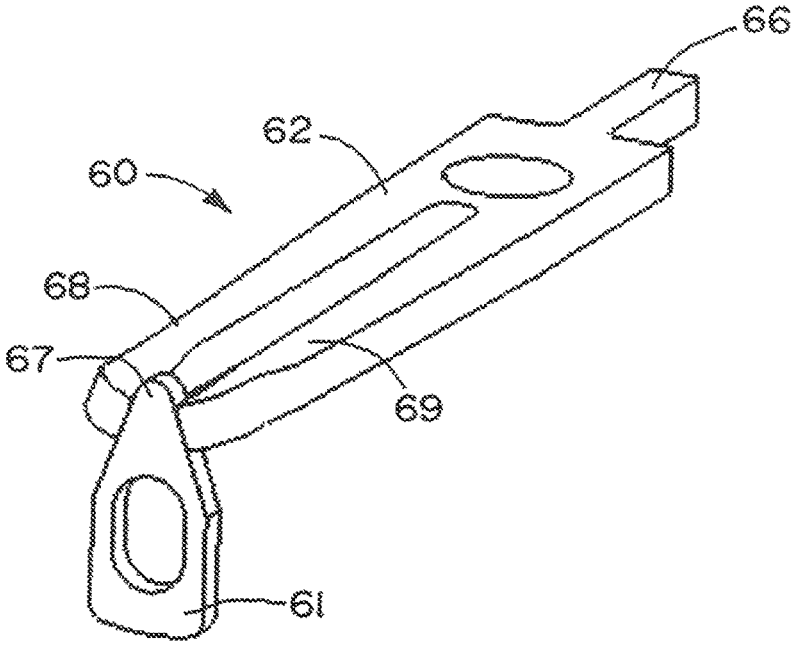
FIG. 3A is an oblique view of an electrical contact, according to another embodiment of the present invention.
Figure 3B:
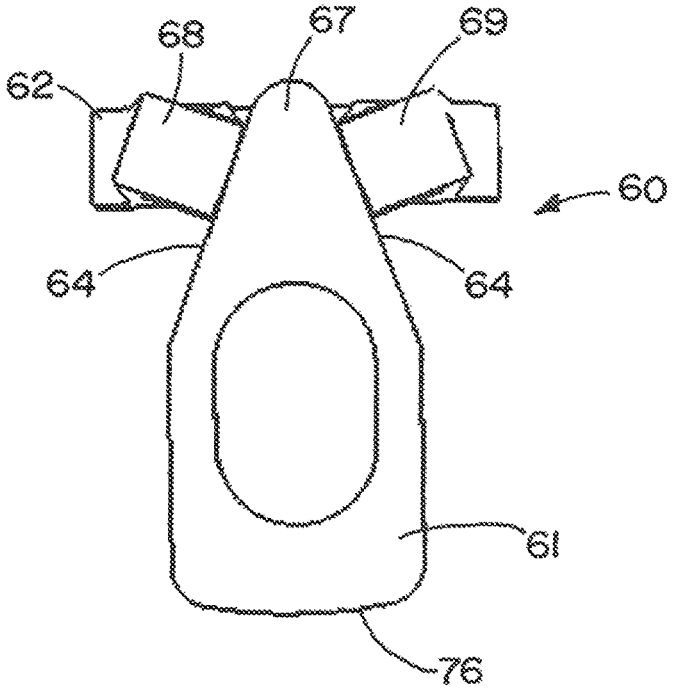
FIG. 3B is a front view of the electrical contact of FIG. 3A.

FIGS. 3A and 3B shows another embodiment, a contact 60. The contact 60 includes a plunger 61 and a fork (receiver) 62. The fork 62 has tines 68 and 69 that are twisted such that they mate with a plunger ramp 64 on a tip 67 of the plunger 61, at the same angle, as shown in FIG. 3B. The result of this modification allows an angled presentation of the plunger 61 relative to the fork receiver 62. FIG. 3B shows the plunger 61 at right angle to the axis of the fork 62. The plunger 61 engages the compliant fork 62 in a direction perpendicular to a major extent of the compliant fork element 62, in a plane in which the fork element 62 extends.

The contact 60 allows use in a right-angle configuration of connector. For example a tip or connector end 66 of the fork 62 may extend from a connector body (not shown in FIGS. 3A and 3B) on a face of the connector body adjacent to another face out of which a rounded or otherwise narrowed plunger end 76 extends.

Figure 4A:
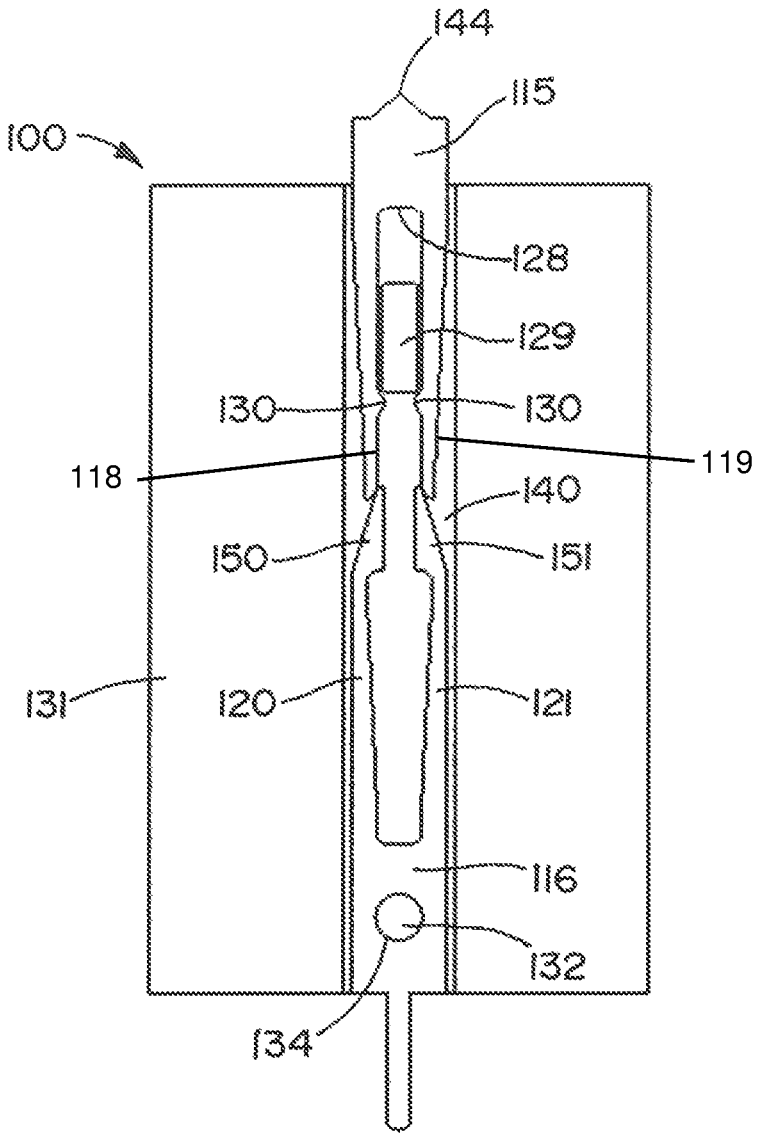
FIG. 4A is a side view of an electrical contact, according to yet another embodiment of the present invention, in an extended configuration.
Figure 4B:
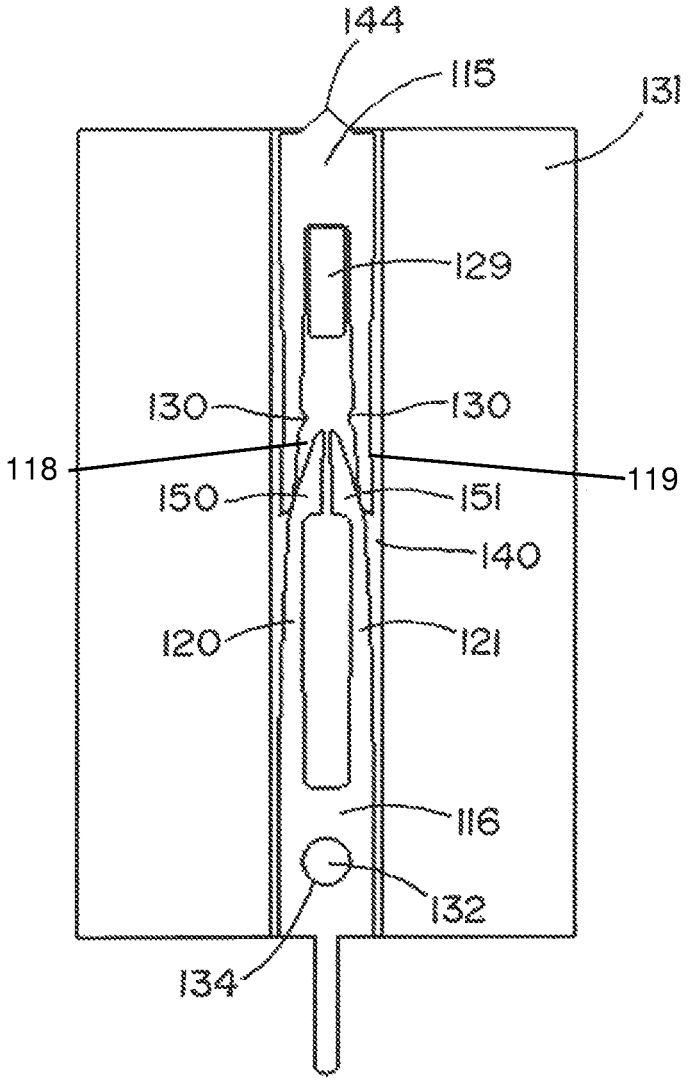
FIG. 4B is a side view of the electrical contact of FIG. 4A, in a deflected configuration.

FIGS. 4A and 4B show a two-fork contact 100 in which a plunger (or plunger fork) 115 incorporates a female fork with tines 118 and 119, and a receiver 116 incorporates a male fork with tines 120 and 121. The deformation of two fork elements 118 and 119 allows for an increase in the amount (distance) of compression possible in the contact. FIG. 4A shows the plunger fork 115 extended, while FIG. 4B shows the plunger fork 115 fully deflected. When the plunger fork is fully deflected, a hard stop is effected by the inside edge 128 of the plunger fork 115 contacting the top of the housing element 129. The plunger 115 is removable for the purpose of replacement. Protrusions 130 are provided on the insides of both female tines 118 and 119 of the plunger 115 such that they retain the plunger in the housing 131 by interfering with the housing element (stop) 129. For replacement, the plunger 115 may be extracted. As the plunger is removed, the tines 118 and 119 of the plunger fork 115 will deflect outward as the protrusions 130 ride up the housing element 129, allowing the plunger 115 to be freed. A replacement plunger may be added by reversing the process.

The housing 131 may be a single unitary continuous plastic piece that surrounds the fork elements (tines) 118 and 119, as well as including the stop 129 and a protrusion 132 into a hole 134, to hold the receiver element 116 in place. The movement of the plunger 115 within a contact channel 140 allows a plunger tip 144 to extend and retract from the connector body or housing 131.

The tines 120 and 121 have end portions 150 and 151 with ramped (sloped) outer surfaces that engage inner surfaces of the tines 118 and 119. The end portions 150 and 151 may be thicker than other parts of the tines 120 and 121, to limit the travel of the tines 120 and 121, and/or to prevent unwanted deformation of the tines 120 and 121.

Some of the features of the contact 100, such as the connector body or housing 131 with the channel 140 therein for receiving parts of the contact 100, may also be a part of other embodiments described herein, such as the embodiments described above. In addition, features of the other embodiments may also be similar to features of the contact 100; these similar features are not repeated in the description of the contact 100.

Figure 5:
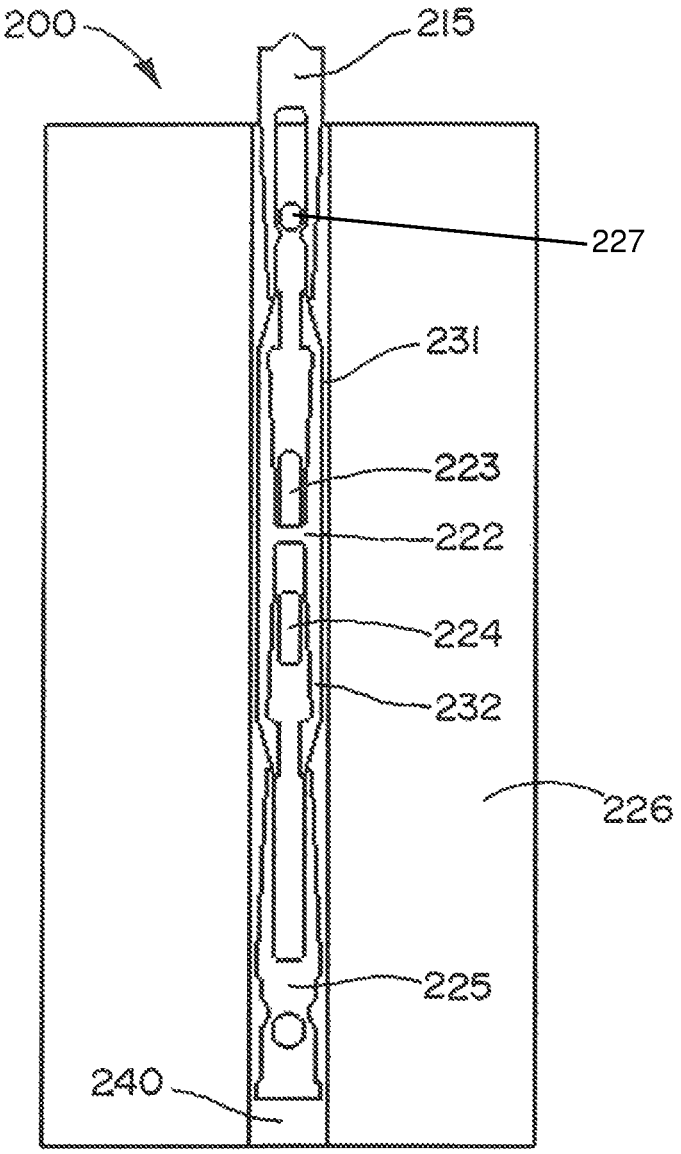
FIG. 5 is a side view of an electrical contact, according to still another embodiment of the present invention.

FIG. 5 shows a contact 200, a four-fork embodiment in which the plunger 215 incorporates a female fork as in the contact 100 (FIGS. 4A and 4B). A center receiver 222 incorporates mirror image male forks 231 and 232 on opposite ends, and is free to move vertically between housing elements 223 and 224. The contact 200 also has a bottom receiver 225 that has a female fork and is fixed relative to the housing 226. The conductive elements or members 215, 222, and 225 are located in a channel 240 in the housing 226. Housing elements 223, 224, and 227 represent fixed stops limiting the travel of elements 215 and 222. The housing element or fixed stop 227 also is a retainer with provisions to allow replacement as before. This arrangement of four forks will yield four times the deflection of the single fork version in the contact 10 (FIGS. 1A and 1B).

Figure 6:
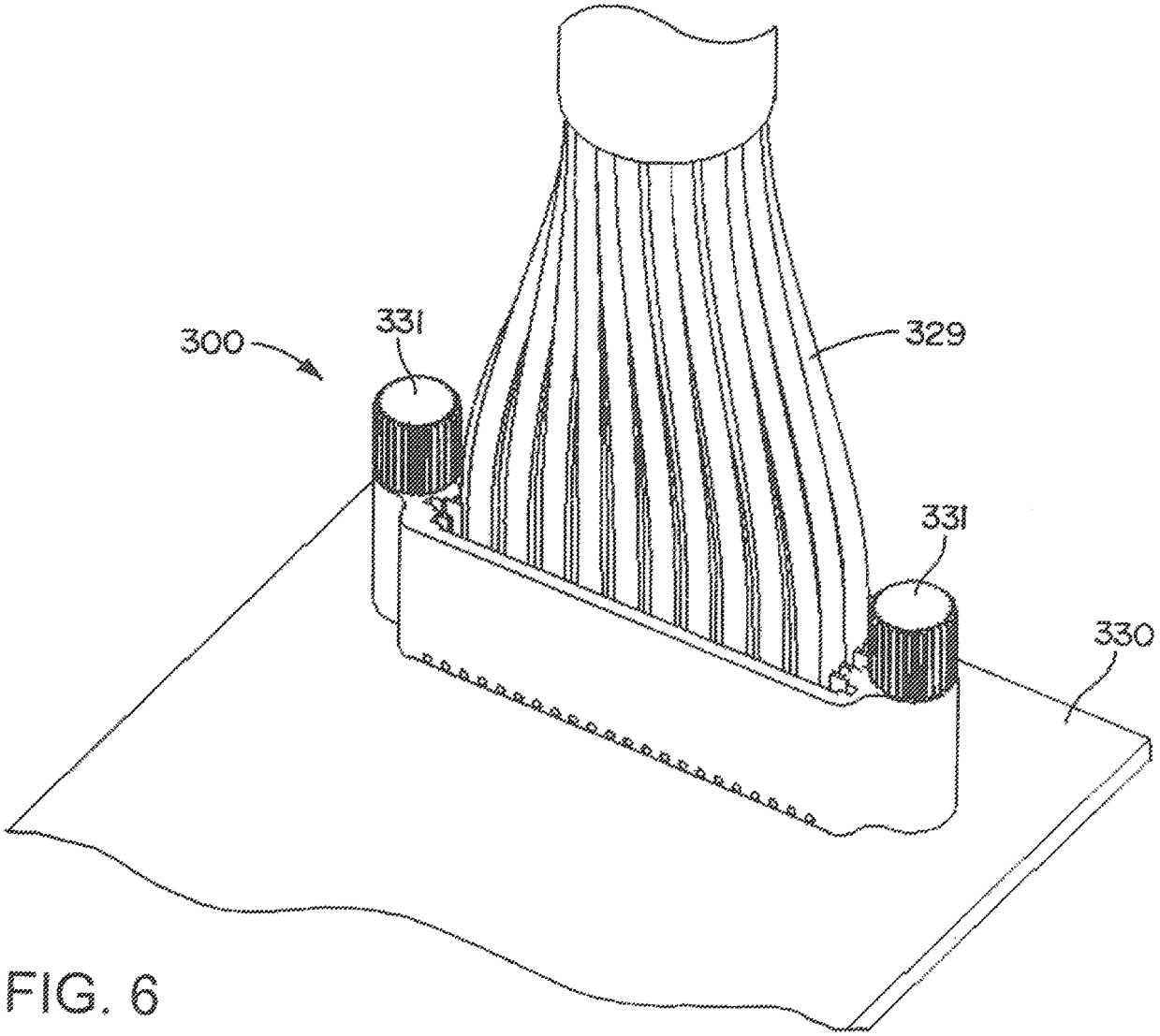
FIG. 6 is an oblique view of a connector using electrical contacts such as those in the previous embodiments, according to an embodiment of the invention.

FIG. 6 shows a connector 300 that electrically attaches sixty (60) co-axial cables 329 to a circuit board 330 using the principals outlined above. The connector 300 containing a co-axial bundle of cables 329 is attached to the circuit board 330 with two thumb screws 331 communicating with threaded inserts in the board 330.

Figure 7:
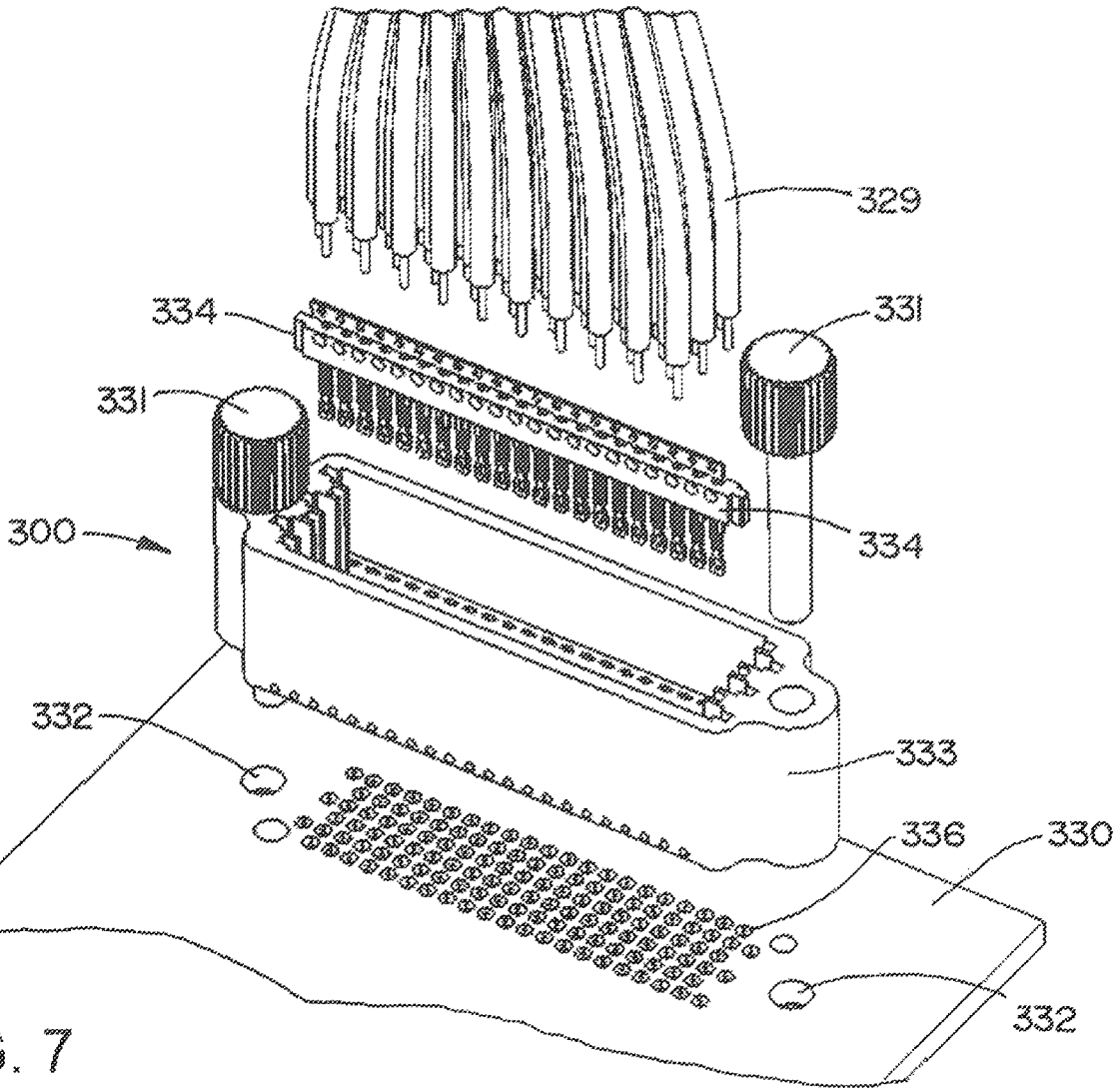
FIG. 7 is an exploded view of the connector of FIG. 6.

FIG. 7 is an exploded view of the connector 300, showing details of construction. The circuit board 330 has two threaded inserts 332 embedded that will accept the two thumb screws 331. The circuit board 330 also has an array of via pads 336. There are six rows of the pads 336, spaced equally apart. Each row has twenty one pads at a constant pitch pad to pad. The pads 336 are connected in the circuit board where the beginning pad of each row is a ground circuit and every other pad is also a ground. The pads in between the grounds are signal pads. Every other row is staggered one pitch in order to isolate signal pads row to row. The connector housing 333 is hollow and contains six contact headers 334 only one of which is shown for clarity. Each of the headers 334 has ten co-axial cables 329 attached, for a total of sixty cables.

Figure 8:
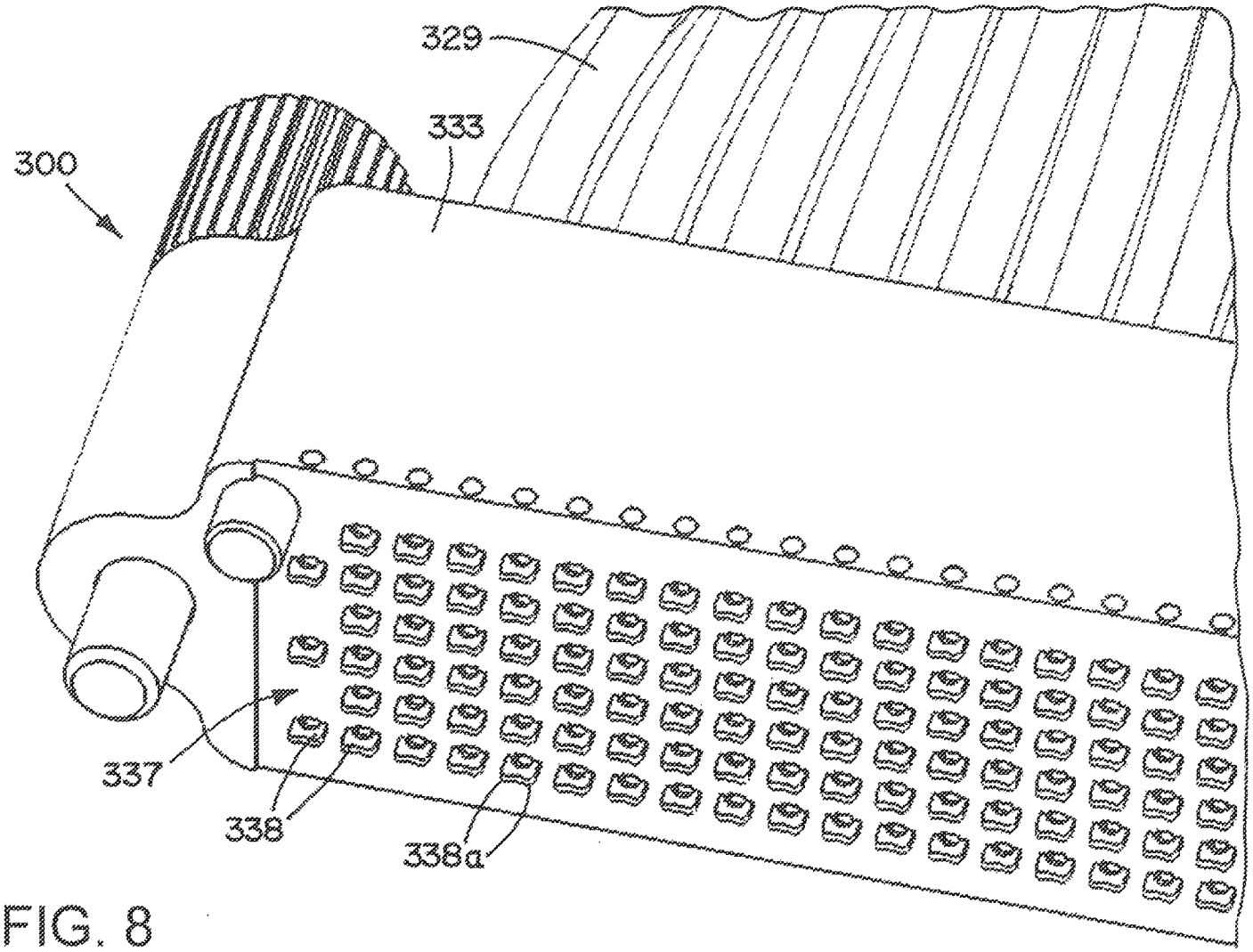
FIG. 8 is an oblique view of part of the connector of FIG. 6.

FIG. 8 shows the plunger array 337 which protrudes from the bottom of the housing 333 of the connector 300, and which will connect in compression to the via pad array 336 of FIG. 7. Note the ends of the plungers 338 of the array 337 have two rounded edges latterly disposed, for example as shown at 338*a*. These two edges will span over the via holes in the via pads 336 of FIG. 7.

Figure 9:
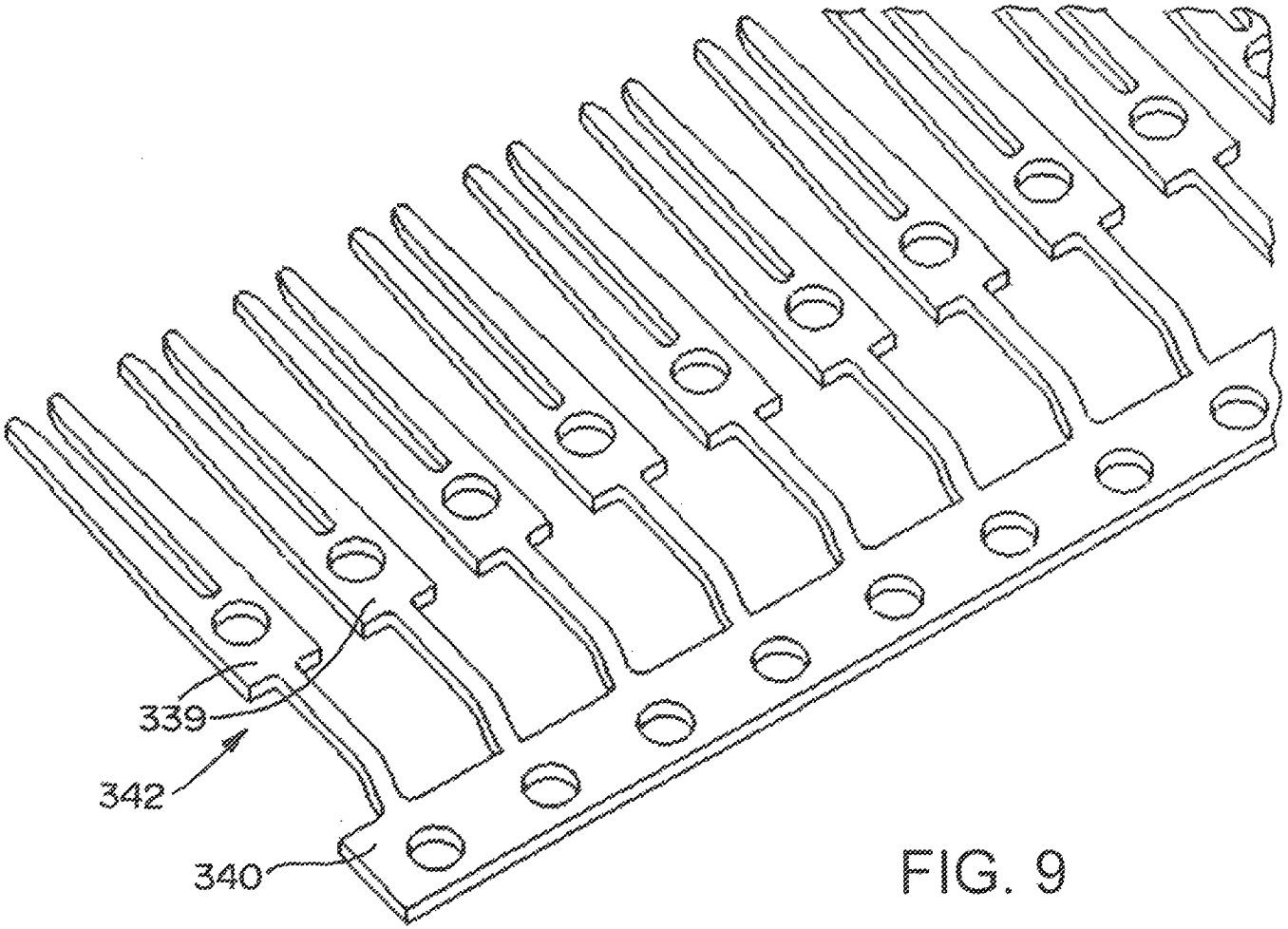
FIG. 9 is an oblique view of a common carrier that is formed as part of the process of making the connector of FIG. 6.

FIG. 9 shows twenty one female fork receivers 339 all attached to a common carrier 340, forming a receiver stamping 342. The common carrier 340 is an artifact of the progressive stamping die and will become the electrical ground buss for every other contact. The common carrier 340 holds all of the fork contacts (receivers) 339 on pitch so that they can be easily loaded into a mold which will overmold a plastic header body.

Figure 10:
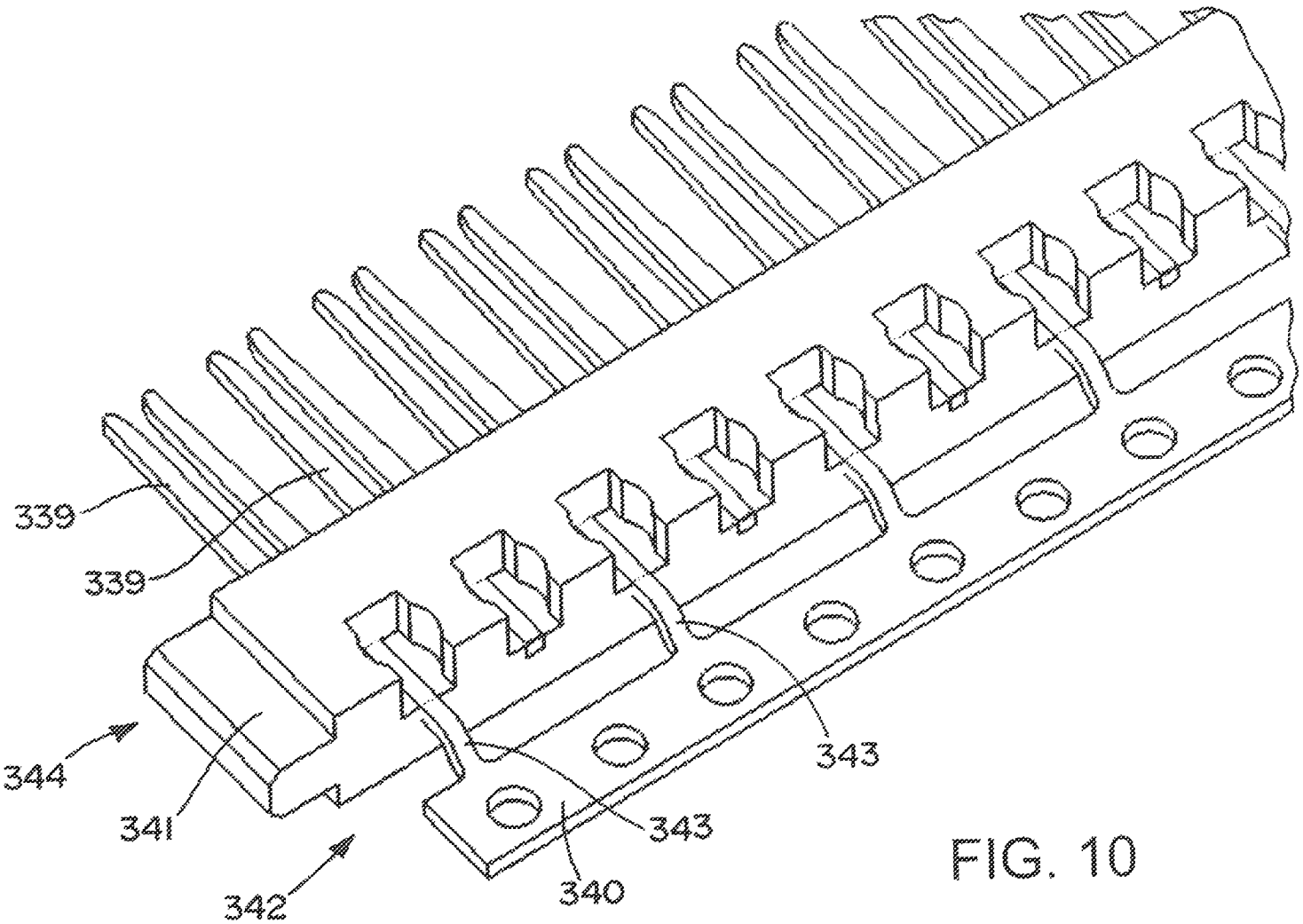
FIG. 10 is an oblique view showing a header formed on the common carrier of FIG. 9.

FIG. 10 shows a completed header 344 made from the common carrier 340. The header body 341 is overmolded onto the receiver stamping 342. Every other contact tail 343 is removed from the ground buss (common carrier) 340 to form a signal contact position.

Figure 11:
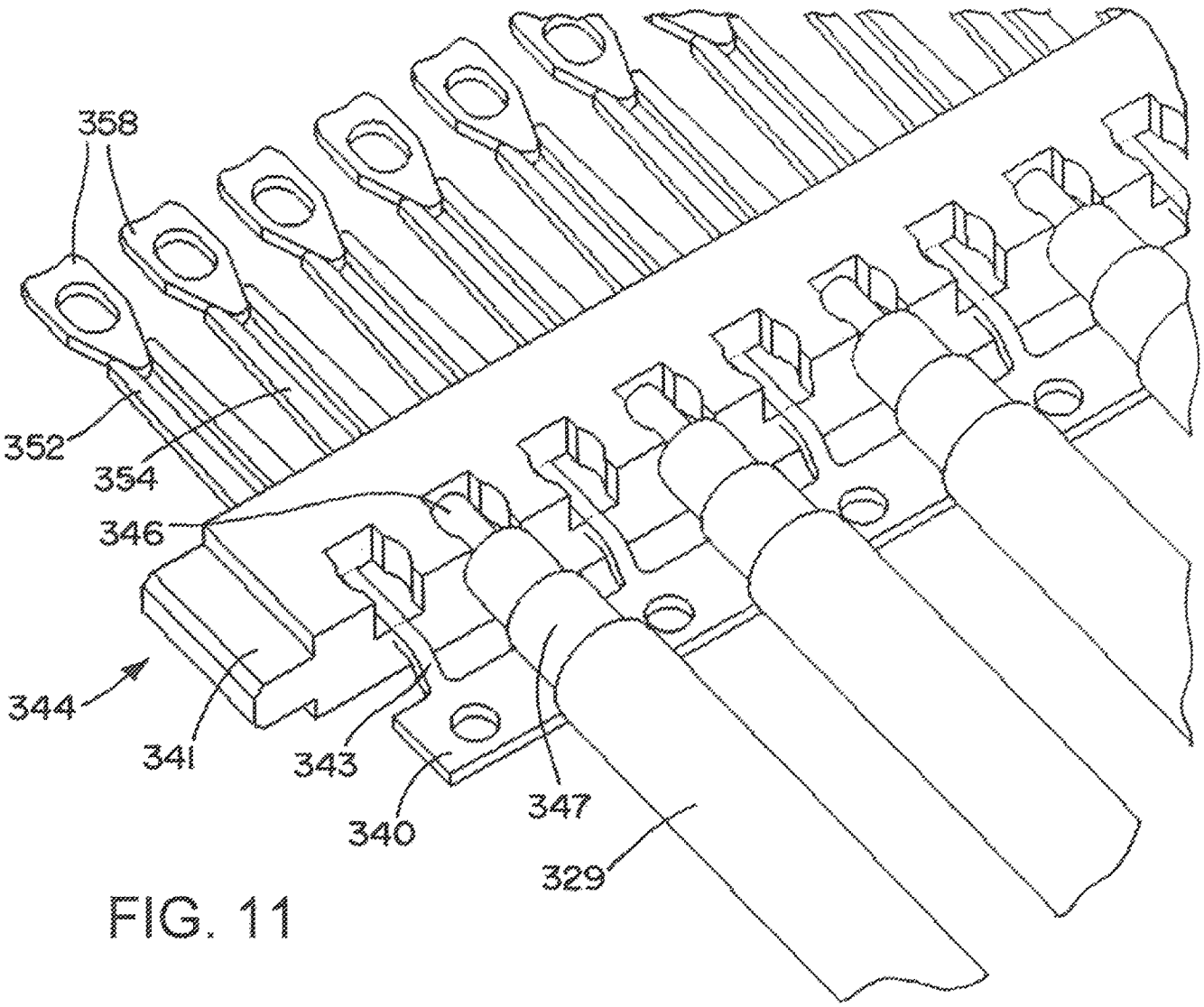
FIG. 11 is an oblique view showing the attachment of coaxial cables to the carrier-header combination of FIG. 10.

FIG. 11 shows co-axial cables 329 attached to header contacts which emanate from the header body 341. The signal wires 346 of the coaxial cables 329 are attached to every other of the contacts. Shields 347 of the coaxial cables 329 are attached to the common ground buss 340. The plungers 358 are shown added to the receivers 352 and 354.

Figure 12:
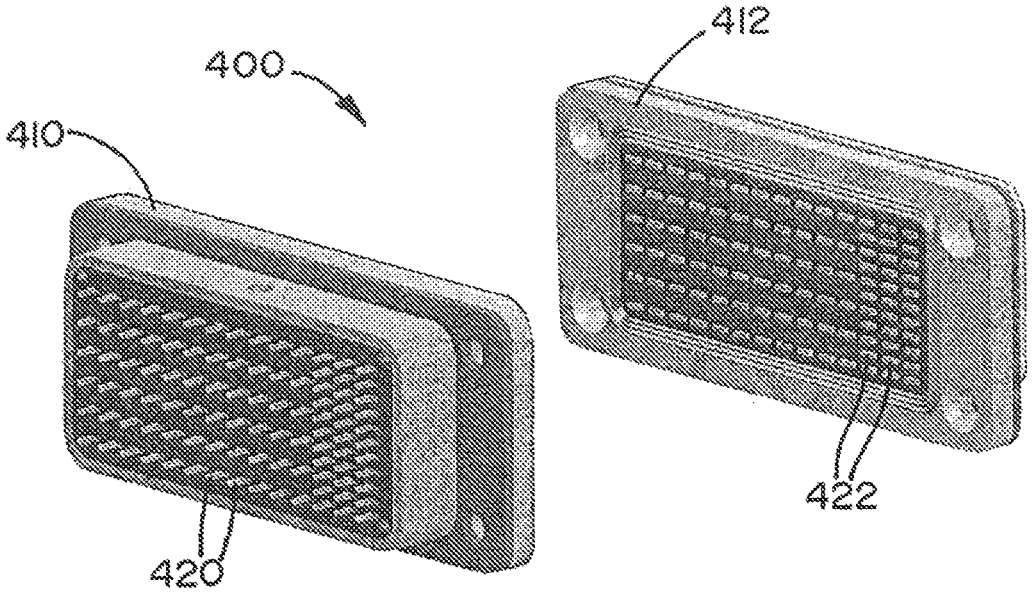
FIG. 12 is an oblique view of a device that includes a pair of connectors, one of which has compliant contacts, in accordance with an embodiment of the invention.

FIG. 12 shows a device 400 with a pair of connectors 410 and 412 that utilize connection using the compliant contacts 420 of a configuration as described above, such as that of the contact 10 (FIG. 1). The connector 410 includes an array of compliant contacts 420, of the sort described above and elsewhere herein. The connector 412 includes a corresponding array of noncompliant contacts 422, which may be conductive pads or vias, either flush with or raised above the surrounding connector material. The connectors 410 and 412 may be held together by any of a variety of known mechanical mechanisms to provide a force to compress the compliant contacts 420 of the connector 410, to make an electrical connection between the compliant contacts 420 and the corresponding non-compliant contacts 422.

The arrangement of the connectors 410 and 412 may be advantageously usable in a variety of situations. For example the connector 412 with the noncompliant contacts 422 may be part of a device which would be exposed to an environment in which delicate contacts were prone to contamination (such as by dirt, moisture, etc.) or physical damage. In such an environment traditional protruding male contacts or traditional female receptacles (for receiving male contacts) may be unsuitable because of the danger of damage or fouling. However use of the connector 412 with the noncompliant contacts 422 does not present the same danger of damage or fouling of contacts, since the noncompliant contacts 422 are flush or nearly flush with the surrounding nonconductive part of the connector 412.

In one example, the noncompliant connector 412 may be part of a handheld device that is used in potentially damaging environment. After the device is used in the potentially damaging environment, it may then be taken to a different (safer) environment, where it is interfaced with another device, for instance to transfer data. The connector 410 with the compliant contacts 420 may be part of the device with which the handheld device interfaces with.

Figure 13:
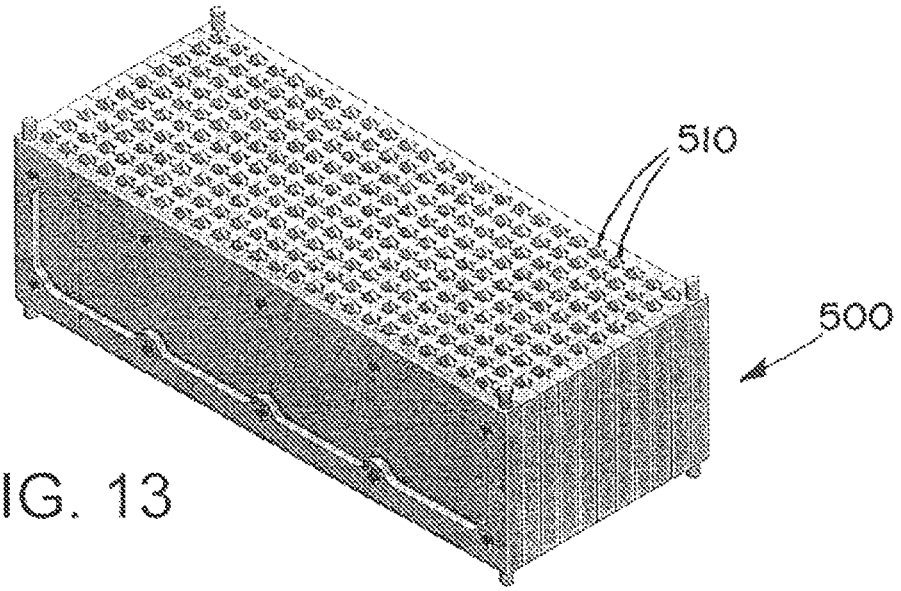
FIG. 13 is an oblique view of a connector that includes compliant contacts, in accordance with still another embodiment of the invention.
Figure 14:
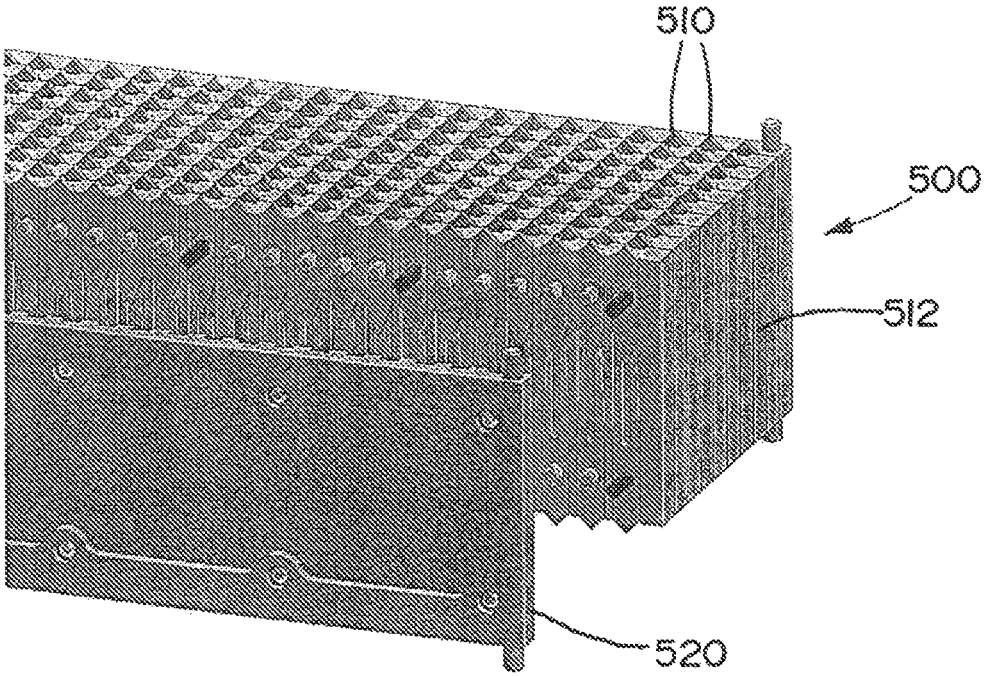
FIG. 14 is a partially exploded view of the connector of FIG. 13.

FIGS. 13 and 14 show a mezzanine connector 500 which can be used to engage sets of noncompliant contacts or contact pads at either end (both top and bottom). Both elements of each compliant contact 510 of the connector 500 may move relative to the body or header 512 of the connector. The connector 500 may be used to link two other connectors, or a pair of circuit boards, for example. The connector 500 may be stacked layers of modules 520, each containing a row of the contacts 510 interspersed between parts of the body 512.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A compliant electrical contact comprising:

a pair of conductive elements that include:

a plunger; and a receiver;

wherein the plunger is movable relative to the receiver to put a plunger fork of the plunger within a receiver fork of the receiver, or a receiver fork of the receiver within a plunger fork of the plunger, to resiliently deform the plunger and/or the receiver, to thereby provide a force of the compliant electrical contact to engage a conductive pad or a noncompliant contact external to the compliant electrical contact;

wherein removal of resilient deformation of the plunger and/or the receiver eliminates an engagement force to engage the conductive pad or the noncompliant contact external to the compliant electrical contact;

wherein the receiver includes a pair or more of laminated fork elements that overlap one another; and wherein the fork elements engage the same plunger.

2. The contact of claim 1, wherein the plunger fork includes a pair of plunger tines that resiliently deform as the plunger and the receiver are engaged; and wherein the receiver fork includes a pair of receiver tines that resiliently deform as the plunger and the receiver are engaged.

3. The contact of claim 1, wherein the elements are in a connector body.

4. The contact of claim 3, wherein at least one of the elements are secured in the connector body by one of more retainers of the connector body that pass into closed or open holes or elongate slots in the elements.

5. The contact of claim 1, wherein at least some of the elements are replaceable elements.

6. The contact of claim 1, wherein the receiver is a first receiver;

further comprising a second receiver;

wherein the first receiver is movable relative to the second receiver, to resiliently deform the first receiver and/or the second receiver, to thereby provide part of the force of the compliant electrical contact to engage a conductive pad or a noncompliant contact external to the compliant electrical contact.

7. The contact of claim 6, wherein the first receiver includes the receiver fork and a second receiver fork on opposite ends, with the receiver fork engaging the plunger, and the second fork engaging the second receiver.

8. The contact of claim 1, wherein the engagement of the receiver and the plunger involves putting a male ramp between a female fork.

9. The contact of claim 8, wherein the male ramp is a male fork.

10. The contact of claim 1, wherein the receiver has a pair of male ramps at opposite ends, for engaging respective female forks of the plunger and a second receiver.

11. The contact of claim 10, wherein the male ramps are male forks.

12. A compliant electrical contact comprising:

conductive elements that include:

a plunger;

a first receiver; and a second receiver;

wherein the plunger is movable relative to the first receiver to put part of the plunger within part of the first receiver or part of the first receiver within part of the plunger, to resiliently deform the plunger and/or the first receiver, to thereby provide a force of the compliant electrical contact to engage a conductive pad or a noncompliant contact external to the compliant electrical contact;

wherein the first receiver is movable relative to the second receiver, to resiliently deform the first receiver and/or the second receiver, to thereby provide part of the force of the compliant electrical contact to engage a conductive pad or a noncompliant contact external to the compliant electrical contact;

wherein the compliant electrical contact is movable between force-producing, and non-force-producing configurations;

wherein the first receiver has a pair of male ramps at opposite ends, for engaging respective female forks of the plunger and the second receiver; and wherein the male ramps are male forks.

13. The contact of claim 12, wherein the elements are in a connector body; and wherein at least one of the elements are secured in the connector body by one of more retainers of the connector body that pass into closed or open holes or elongate slots in the elements.

14. The contact of claim 12, wherein the engagement of the first receiver and the plunger involves putting a male ramp between a female fork; and wherein the male ramp is a male fork.

* * * * *